United States Patent [19]

Berger et al.

[11] 4,450,017

[45] May 22, 1984

[54] GASEOUS DECARBURIZING MIXTURES OF HYDROGEN, CARBON DIOXIDE AND A CARRIER GAS

[75] Inventors: Kerry R. Berger, Lehighton, Pa.; Jelle H. Kaspersma, Hazerswoude-Dozp, Netherlands; Joseph R. Luybli, Hellertown, Pa.; Barry Millward, La Place, La.; Robert H. Shay, Kutztown, Pa.

[73] Assignee: Air Products and Chemicals, Inc., Allentown, Pa.

[21] Appl. No.: 435,834

[22] Filed: Oct. 21, 1982

[51] Int. Cl.[3] ..... C21D 1/00

[52] U.S. Cl. ..... 148/16; 148/16.5; 148/16.6; 148/20.3

[58] Field of Search ..... 148/16, 16.5, 16.6, 148/20.3

[56] References Cited

U.S. PATENT DOCUMENTS

| | | | |
|---|---|---|---|
| 3,098,776 | 7/1963 | Elavde | 148/16 |
| 4,139,375 | 2/1979 | Solomon et al. | 148/20.3 |
| 4,285,742 | 4/1981 | Bowes et al. | 148/16 |

*Primary Examiner*—Veronica O'Keefe

*Attorney, Agent, or Firm*—James C. Simmons; E. Eugene Innis

[57] ABSTRACT

A process for decarburizing ferrous metals and in particular electrical steels such as motor and transformer laminations wherein metal articles are treated at temperature under a furnace atmosphere generated by injecting $N_2$—$CO_2$—$H_2$ mixtures or $N_2$-methanol-$CO_2$ mixtures into the furnace.

7 Claims, 1 Drawing Figure

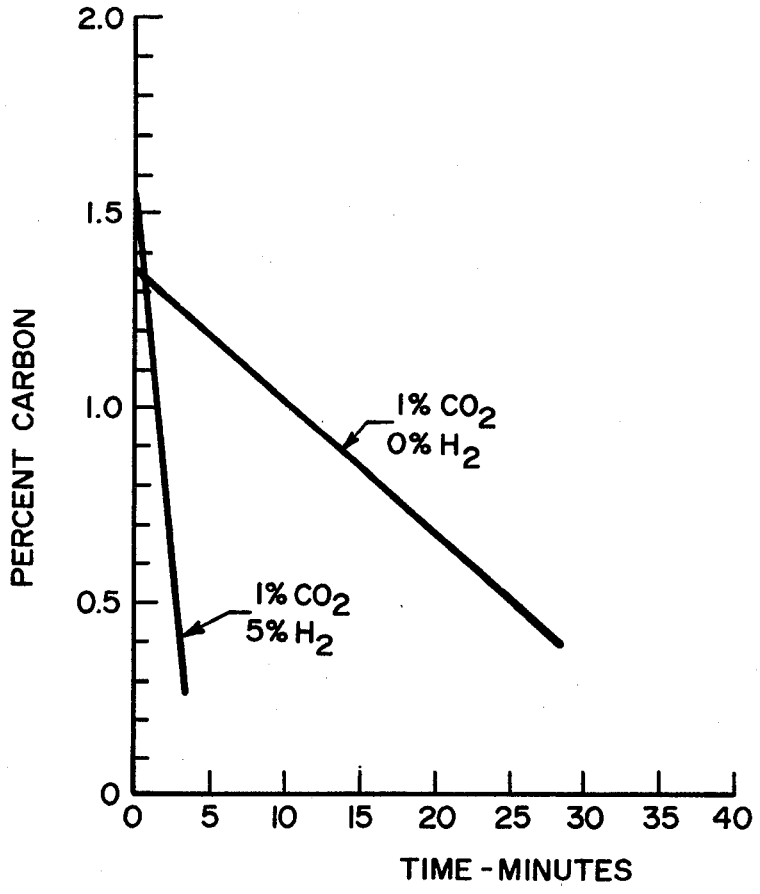
2.0
1.5
1.0
0.5
0
PERCENT CARBON
1% CO2
0% H2
1% CO2
5% H2
0
5
10
15
20
25
30
35
40
TIME - MINUTES

GASEOUS DECARBURIZING MIXTURES OF HYDROGEN, CARBON DIOXIDE AND A CARRIER GAS

TECHNICAL FIELD

This invention pertains to decarburization of ferrous metal articles such as sheet steel usable for electrical devices such as motors and transformers.

BACKGROUND OF THE PRIOR ART

For certain technical applications, it is necessary to reduce the carbon content of steel to a low value. An important example is the removal of carbon from thin sheet steel laminations used in the magnetic circuits of electric motors and transformers. It is desired in this application to lower the carbon level to a few thousandths of a percent in order to minimize hysteresis losses. A further objective, usually achieved as a part of the same process by which the carbon content of the laminations is lowered, is the production of a thin, adherent coating of iron oxide on the lamination. This oxide coating, having a low electrical conductance, effectively insulates the laminations from one another and prevents the flow of eddy currents which would result in large electical losses. The oxide coating appears as a uniform dark blue coloration on the surface of the finished part.

The decarburization is normally carried out below the ferrite-austenite transition temperature of pure iron, that is, below a temperature of about 1670° F. (910° C.). A typical decarburization temperature is 1450° F. (788° C.) although higher or lower temperatures may be employed if desired. By carrying out the decarburization below the transition temperature, as carbon is removed from the piece large crystals of alpha iron (ferrite) grow from the surface inward. This large-grained structure confers good magnetic properties to the finished parts.

Decarburization is achieved by exposing the parts to an atmosphere having a composition such that carbon dissolved in the metal reacts to produce gaseous products which are then swept away from the surface. Conventional heat treating literature alleges that three substances normally found in heat treating atmospheres are capable of reacting with dissolved carbon to produce gaseous products. These are hydrogen, water and carbon dioxide, according to the following reactions:

$$C+2H_2 \rightarrow CH_4 \quad (1)$$

$$C+H_2O \rightarrow CO+H_2 \quad (2)$$

$$C+CO_2 \rightarrow 2CO \quad (3)$$

Water is regarded as being effective at low concentrations, with carbon dioxide acting much slower and hydrogen as having very little reactivity. Water and carbon dioxide, if present in sufficiently high concentration, are capable of oxidizing the iron to iron oxides according to the following equations:

$$Fe+xH_2O \rightarrow FeO_x+xH_2 \quad (4)$$

$$Fe+xCO_2 \rightarrow FeO_x+xCO \quad (5)$$

Where x ranges from 1.0 to 1.5

Water is much more potent than carbon dioxide as an oxidizing agent. Although a final oxidation to produce the thin, adherent insulating coat is desired, oxidation must be avoided during the decarburization process so that the decarburization agent has free access to the metal surface, and outward diffusion of carbon is not hindered by an oxide layer.

Further it is important that oxide formation shall not occur at temperatures above 1030° F. (554° C.), since ferrous oxide, FeO, will be formed, whereas below this temperature magnetite, $Fe_3O_4$, is produced. Ferrous oxide may cause laminations, which are commonly decarburized in stacks, to adhere to one another while magnetite is much less objectionable.

Traditionally, decarburizing atmospheres have been generated in a number of ways. One process involves the production of so-called exothermic gas by combustion of natural gas in air. The resulting atmosphere consists of nitrogen, carbon dioxide, water, and, depending upon the ratio of fuel to air, more or less hydrogen and carbon monoxide. It may be necessary to cool the gas to condense part of the large amount of water and then reheat it in order to avoid oxidation of the metal. The rising cost of natural gas, its short supply and its variable composition make it an increasingly less attractive primary source for generating an atmosphere.

Another atmosphere which has been employed is a humidified hydrogen/nitrogen mixture such as disclosed in U.S. Pat. No. 3,098,776. A three-to-one hydrogen/nitrogen mixture may be produced by the cracking of ammonia. An alternate approach is to employ relatively low-cost nitrogen to which is added a small quantity of hydrogen. To both of these atmospheres it is necessary to add water, either as steam or as a liquid which is then vaporized. The advantage of this approach is the consistent composition of the atmosphere and simpler process equipment. The disadvantage is that it is essential that the concentration of water in the atmosphere be carefully controlled to a low level to avoid the possibility of early oxidation of the metal surface. Another disadvantage is that the hydrogen/nitrogen atmosphere may cost more than an exo-atmosphere.

Another process is disclosed in U.S. Pat. No. 4,285,742 wherein mixtures of an inert gas, water and a compound of carbon, hydrogen and oxygen are used to effect decarburization of electrical steels. The compounds of carbon, hydrogen and oxygen identified by patentees are preferably methanol with additions of, or alternatively, a high aliphatic alcohol and/or acetone. The composition is selected so that the furnace atmosphere, at temperature, contains at least 1% water vapor.

BRIEF SUMMARY OF THE INVENTION

The present invention relates to a process for decarburizing ferrous metal articles such as sheet steel used in the manufacture of electrical motors and transformers. The articles to be decarburized are charged into a furnace heated to a temperature of between 1200° F. (649° C.) and 1700° F. (927° C.) under an atmosphere developed inside the furnace by injecting a mixture of 1–20% by volume hydrogen, 1–50% by volume carbon dioxide, balance nitrogen. As a source of hydrogen for the process, a mixture of from 0.5 to 10% by volume methanol with from 1–50% by volume carbon dioxide balance nitrogen can be injected into the furnace. Preferably a mixture of 4% by volume methanol, with between 1 and 5% by volume carbon dioxide, balance nitrogen injected into the furnace while heating and cooling the articles being treated achieves the desired result.

The atmosphere which is readily prepared from inexpensive and easily handled raw materials of constant composition, requires no processing equipment external to the decarburizing furnace. In addition to the ready control of the decarburization processes, the basic decarburizing gas can, at lower temperatures, be altered so as to effect the desired blueing oxidation of the metal surface.

BRIEF DESCRIPTION OF THE DRAWING

The single FIGURE of the drawing is a plot of percent carbon against time showing the effect of hydrogen on the rate of decarburization of low carbon steel shimstock having a thickness of 0.002" (0.05 mm) in a nitrogen-carbon dioxide atmosphere.

DETAILED DESCRIPTION OF THE INVENTION

In one embodiment the improved process of the invention consists of exposing the metal to be decarburized to an atmosphere consisting of from 1–50% of carbon dioxide, 1–20% of hydrogen and the balance an inert gas such as nitrogen, at a temperature between about 1400° F. (760° C.) and 1700° F. (927° C.). The decarburization proceeds smoothly and, depending upon the level of carbon dioxide in the atmosphere, as rapidly as that effected by water. Although hydrogen has been claimed to have only a weak decarburizing effect, according to the equation $C+2H_2 \rightarrow CH_4$, it has been found that the addition of a small amount of hydrogen to the carbon dioxide/nitrogen atmosphere has a marked accelerating effect. The rate of decarburization is significantly greater than that which would be predicted by linear addition of the decarburizing rates of hydrogen and carbon dioxide alone. It is believed that the function of the hydrogen is to keep the surface of the metal free of adsorbed oxygen which retards decarburization and may be formed by reaction of carbon dioxide. In summary, therefore, the role of carbon dioxide is primarily that of a decarburizing agent, while that of hydrogen is to remove adsorbed oxygen and facilitate decarburization.

The decarburizing atmosphere may be generated by simply combining the gaseous hydrogen, carbon dioxide, and nitrogen. Alternatively, the hydrogen component of the atmosphere may be produced by the thermal decomposition of methanol. In this case, carbon dioxide may be added as such, or may be produced by the addition of water which reacts with the carbon monoxide from the methanol.

$$CH_3OH \rightarrow 2H_2 + CO$$

$$CO + H_2O \rightarrow H_2 + CO_2$$

The following examples illustrate the operation of this invention:

EXAMPLE I

A series of experiments was conducted to investigate the rate of loss of carbon from steel at two temperatures, 1400° F. (760° C.) and 1700° F. (927° C.), in the presence of an atmosphere containing carbon dioxide, hydrogen and nitrogen. A strip of low carbon (0.06% C) steel approximately 0.4" (10.2 mm)×1.6" (40.6 mm) and 0.002" (0.05 mm) in thickness was suspended from a microbalance in a fused silica tube. The central portion of the tube was surrounded by an electrically-heated furnace. Thermocouples within the tube provided a means of measuring and controlling the temperature. A means of passing a flow of nitrogen containing various gaseous additives upward through the tube was provided. Changes in the mass of the steel strip was detected by the electronic microbalance and permanently recorded on a strip chart.

A typical run was carried out by passing a flow of inert gas (nitrogen) over the strip and heating the furnace to the desired experimental temperature. The strip was then carburized from the as-received level of 0.06% to a level of between 1.3% and 1.5% carbon by passing a mixture of nitrogen, carbon monoxide and hydrogen through the furnace. When the desired gain in weight had occurred, the carburizing gases were turned off and decarburizing gases ($H_2/H_2O$ or $H_2/CO_2$) were introduced into the flowing nitrogen stream. The composition of the gas entering the furnace was established by adjusting the rate of gas flow through calibrated flow meters and verified by removing samples for chromatographic analysis from the gas stream as it entered the bottom of the furnace.

The mass change as determined by the microbalance was converted to percent carbon in the sample and the results were plotted. Two typical decarburization experiments are shown in the plot of the single FIGURE of the drawing.

For purposes of comparing different experiments the slopes of the linear plots were determined. The slopes were combined with weights and dimensions of the test strips to yield the surface reaction rate, expressed as moles of carbon lost per unit area per unit time. The results of a series of experiments at two temperatures with various concentrations of hydrogen and either carbon dioxide or water vapor are shown in Tables I and II respectively.

TABLE I

Decarburization by $H_2$—$CO_2$ Mixtures

| Run No. | Temp. °F. | % $H_2$ | % $CO_2$ | % $H_2O$ | Rate of Carbon Loss $\frac{MOL}{Cm^2\ min} \times 10^{-6}$ |
|---|---|---|---|---|---|
| 1 | 1700 | 0 | 1.0 | — | 0.54 |
| 2 | 1700 | 1 | 0.97 | — | 2.43 |
| 3 | 1700 | 2 | 0.98 | — | 4.04 |
| 4 | 1700 | 5.5 | 0.95 | — | 5.34 |
| 5 | 1700 | 18.5 | 0.96 | — | 6.81 |
| 6 | 1700 | 10.0 | 1.0 | — | 7.20 |
| 7 | 1700 | 2.1 | 4.90 | — | 14.02 |
| 8 | 1400 | 6.6 | 4.55 | — | 1.13 |
| 9 | 1400 | 5.7 | 19.4 | — | 2.20 |
| 10 | 1400 | 2.1 | 49.3 | — | 2.98 |
| 11 | 1400 | 5.8 | 48.4 | — | 3.18 |
| 12 | 1400 | 10.3 | 49.1 | — | 3.20 |

TABLE II

Decarburization by $H_2$—$H_2O$ Mixtures

| Run No. | Temp. °F. | % $H_2$ | % $CO_2$ | % $H_2O$ | $\frac{MOL}{Cm^2\ min} \times 10^{-6}$ |
|---|---|---|---|---|---|
| 1 | 1700 | 1 | — | 0.94 | 18.5 |
| 2 | 1700 | 2 | — | 0.92 | 19.2 |
| 3 | 1700 | 5 | — | 0.89 | 20.2 |
| 4 | 1700 | 10 | — | 1.02 | 14.9 |
| 5 | 1400 | 3.0 | — | 0.75 | 4.50 |
| 6 | 1400 | 5.6 | — | 0.77 | 4.16 |
| 7 | 1400 | 9.1 | — | 0.43 | 2.67 |
| 8 | 1400 | 9.2 | — | 0.77 | 4.39 |

TABLE II-continued

| Decarburization by $H_2$—$H_2O$ Mixtures | | | | | |
|---|---|---|---|---|---|
| Run No. | Temp. °F. | % $H_2$ | % $CO_2$ | % $H_2O$ | $\frac{MOL}{Cm^2\ min} \times 10^{-6}$ |
| 9 | 1400 | 9.0 | — | 2.10 | 5.57 |

A number of facts are evident from the foregoing tables. In Table I, Run 1 shows that without hydrogen the rate of decarburizing by carbon dioxide alone is slow. In Runs 2 through 5 an increase in hydrogen causes an increase in the rate of decarburization, although the relative increase shown is far less than the 5-fold increase brought about by the first one percent of hydrogen. Comparison of Runs 3 and 7 show a 3.5-fold increase in rate of carbon loss as a result of a 5-fold increase in $CO_2$. Similar less-than-first-order increases are observed in Runs 7 through 11 carried out at a lower temperature.

Table II shows a similar increase in the rate of decarburization as the concentration of the active agent, water is increased. However, also evident is a decline in rate with increasing hydrogen concentration, as in Run 4 as compared to Run 1, and Run 6 compared to Run 5. This decline may be interpreted as an inhibition of the $H_2O$ decarburization of steel by hydrogen, a product of the reaction. These observations support the premise that hydrogen itself is not an effective decarburizing agent, but rather performs its useful function by keeping the surface free of oxides so that reaction of $H_2O$ or $CO_2$ is facilitated.

It will be noted that the rate of decarburization at 1400° F. (760° C.) is substantially less than that at 1700° F. (927° C.), but at the lower temperature $CO_2/H_2$ mixtures can perform nearly as rapidly as $H_2O/H_2$ mixtures. For practical work with thicker work pieces, carbon dioxide-based systems can be fully as effective as water-based systems since the rate of decarburization becomes controlled by the rate of diffusion of carbon within the work piece rather than the rate of reaction at the surface.

EXAMPLE II

A series of decarburizing and blueing experiments was conducted with stator lamination bundles in atmospheres of $N_2/H_2/H_2O$ and $N_2/H_2/CO_2$ in a continuous belt furnace. Input blends, see below, were injected into the hot zone of the furnace and 20% $CO_2/N_2$ was injected into the cooling zone. Temperature and residence times of the hot zone and cooling zone were 1500° F. (816° C.) and 45 minutes and 800° F. (427° C.) (initial) and 20 minutes, respectively. The laminates originally contained between 0.053 and 0.060 percent carbon.

| Input Blends | | Residual Carbon (%) | Color | Sticking |
|---|---|---|---|---|
| 6% $H_2$ | 1.7% $H_2O$ | 0.019 | grey | moderate |
| 10% $H_2$ | 18.5% $CO_2$ | 0.006 | blue | light |

Blueing with $CO_2$ was more uniform, had a better color, exhibited less sticking, and decarburized to a lower residual percent carbon. Further examination showed that the $CO_2$ experiment had the desired course crystalline microstructure as compared to the fine crystalline microstructure of the $H_2O$ experiment.

In another embodiment of the present invention a process is utilized whereas the articles (metal) to be decarburized is exposed to a furnace atmosphere derived from injecting a mixture of liquid methanol, carbon dioxide, and nitrogen mixture into the furnace. The methanol dissociates to provide, inter alia, hydrogen in the furnace atmosphere to provide effective decarburization. Example III summarizes the results of preliminary experiments using a methanol-nitrogen base atmosphere containing carbon dioxide and/or water vapor.

EXAMPLE III

A series of decarburizing experiments was conducted with stator lamination bundles in mixtures of $N_2/MeOH/CO_2$ and $N_2/MeOH/H_2O$ in a batch furnace at 1440° F. (782° C.) for 60 minutes. The laminates originally contained 0.039 percent carbon. Input blends are listed below. Methanol was injected as a liquid.

| Run | Input Blends | | | % C Residual | State |
|---|---|---|---|---|---|
| 1 | 4% MeOH | 3% $H_2O$ | 3% $CO_2$ | 0.004 | oxidized |
| 2 | 4% MeOH | 3% $H_2O$ | — | 0.002 | reduced |
| 3 | 4% MeOH | — | 3% $CO_2$ | 0.002 | reduced |

Run 1 exhibited sticking and oxidation. Runs 2 and 3 showed improved decarburization and less sticking of laminates.

As the result of the work summarized above further decarburization tests using methanol-carbon dioxide-nitrogen and methanol-water vapor nitrogen mixture were run on strip steel having an initial carbon content of approximately 0.05%. The strips placed in bundles of 60 to 70 pieces were heated to 760° C. for two and three quarter hours, held at 650° C. for one and one quarter hours in the furnace utilizing the input mixture and furnace atmospheres set out in Table III below and then cooled to below 350° C. in an atmosphere of 100% nitrogen.

TABLE III

DECARBURIZATION OF LOW-CARBON STEEL

| | Inlet Composition | | | | Furnace Atmosphere Composition | | | | Dew Point | | | Average |
|---|---|---|---|---|---|---|---|---|---|---|---|---|
| Run No. | % MeOH | % $CO_2$ | % $H_2O$ | | % CO | % $H_2$ | % $CO_2$ | % $CH_4$ | (°C.) | (% $H_2O$) | | Carbon Content (%) |
| 1 | 4 | 5 | — | a[1] | 5.65 | 5.55 | 3.95 | 0.46 | −6 | (0.36) | c[2] | 0.0030 |
| | | | | b | 3.30 | 4.71 | 5.10 | 0.28 | −6 | (0.36) | d | 0.0032 |
| 2 | 4 | 3 | | a | 4.67 | 6.40 | 3.07 | 0.63 | −7 | (0.34) | c | 0.0038 |
| | | | | b | 3.19 | 6.31 | 3.93 | 0.94 | −6 | (0.36) | d | 0.0036 |
| 3 | 4 | 1 | | a | 3.98 | 7.35 | 1.36 | 0.25 | −5 | (0.40) | c | 0.0046 |
| | | | | b | 3.56 | 7.26 | 1.50 | 0.57 | −13 | (0.20) | d | 0.0038 |
| 4 | 4 | — | 1.2 | a | 5.07 | 10.2 | 0.75 | 0.27 | −2 | (0.51) | c | 0.0058 |
| | | | | b | 3.17 | 8.00 | 1.00 | 0.63 | −2 | (0.51) | d | 0.0041 |
| 5 | 4 | — | 2.3 | a | 4.95 | 8.65 | 0.76 | 0.24 | 0 | (0.60) | c | 0.049 |

TABLE III-continued

DECARBURIZATION OF LOW-CARBON STEEL

| Run No. | Inlet Composition % MeOH | % $CO_2$ | % $H_2O$ | | Furnace Atmosphere Composition % CO | % $H_2$ | % $CO_2$ | % $CH_4$ | Dew Point (°C.) | (% $H_2O$) | | Average Carbon Content (%) |
|---|---|---|---|---|---|---|---|---|---|---|---|---|
| | | | | b | 4.07 | 7.65 | 1.00 | 0.62 | 0 | (0.60) | d | 0.052 |

a(1)Furnace at 760° C.
b Furnace at 650° C.
c(2)Sample selected from end of stack
d Sample selected from middle of stack From the foregoing Table III it is known that methanol-nitrogen input mixtures with 1% to 5% carbon dioxide produce effective decarburization.

The tests using methanol-water nitrogen injection mixtures were not successful. It is believed that in the tests of run 5 the strips were oxidized to FeO thus preventing any significant decarburization from occuring. This was consistent with prior findings that controlled decarburization without oxidation is easier to achieve with $CO_2$ than with water.

Having thus described our invention what is desired to be secured by Letters Patent of the United States is set forth in the attached claims.

What is claimed is:

1. A method of decarburizing thin sheet steel articles comprising the steps of:

charging the articles into a heating furnace maintained at a temperature of between 1200° F. (649° C.) and 1700° F. (927°);

injecting a mixture consisting essentially of from 1 to 20% by volume hydrogen selected from the group consisting essentially of gaseous hydrogen, and hydrogen derived from the decomposition of liquid methanol, 1–50% by weight carbon dioxide balance nitrogen into said furnace whereby a decarburizing atmosphere is created inside said furnace;

holding the articles at temperature and under atmosphere for a period sufficient to produce the desired level of thorough decarburization; and cooling the articles to room temperature.

2. A method according to claim 1 wherein the furnace is maintained at a temperature of 1700° F. (927° C.) and said inlet mixture contains at least 4.9% by volume carbon dioxide, 2.1% by volume gaseous hydrogen, balance nitrogen.

3. A method according to claim 1 wherein the furnace temperature is maintained at 1400° F. (760° C.) and said inlet mixture contains at least 4.55% by volume carbon dioxide, 6.6% by volume gaseous hydrogen, balance nitrogen.

4. A method according to claim 1 wherein said articles are, in addition to being decarburized, also blued by heating said articles and holding at a temperature of 1500° F. (816° C.) followed by initial cooling to a temperature of 800° F. (427° C.) both steps under an atmosphere created by an inlet mixture consisting essentially of 18.5% by volume carbon dioxide, 10% by volume gaseous hydrogen, balance nitrogen, followed by cooling to room temperature.

5. A method according to claim 1 comprising the steps of:

charging the articles into a heat treating furnace maintained at a temperature of between 1200° F. (649° C.) and 1400° F. (760° C.);

injecting a mixture consisting essentially of 0.5 to 10% methanol by volume, between 1 and 50% by volume $CO_2$, balance nitrogen into said furnace whereby said components react to form a decarburizing atmosphere inside said furnace;

holding the articles at temperature and under atmosphere for a period sufficient to produce the desired level of thorough decarburization; and cooling articles to room temperature.

6. A process according to claim 5 wherein said mixture contains about 4% by volume methanol, 1 to 5% by volume $CO_2$, balance nitrogen.

7. A process according to claim 6 wherein said mixture contains at least 3% by volume carbon dioxide.

* * * * *

UNITED STATES PATENT AND TRADEMARK OFFICE

CERTIFICATE OF CORRECTION

PATENT NO. : 4,450,017

DATED : May 22, 1984

INVENTOR(S) : Kerry R. Berger, et al

It is certified that error appears in the above-identified patent and that said Letters Patent is hereby corrected as shown below:

Column 5, Line 18
Delete "7" and substitute therefor -- 8 --
Delete "11" and substitute therefor -- 12 --

Signed and Sealed this

*Ninth* Day of *July 1985*

[SEAL]

*Attest:*

DONALD J. QUIGG

*Attesting Officer* *Acting Commissioner of Patents and Trademarks*